US005391066A

United States Patent [19]

Sawai et al.

[11] Patent Number: 5,391,066

[45] Date of Patent: Feb. 21, 1995

[54] MOTOR COMPRESSOR WITH LUBRICANT SEPARATION

[75] Inventors: Kiyoshi Sawai, Otsu; Manabu Sakai, Kusatsu; Sadao Kawahara, Otsu; Shotaro Ito, Shiga; Yoshinori Kojima; Michio Yamamura, both of Kusatsu; Shuichi Yamamoto, Otsu, all of Japan

[73] Assignee: Matsushita Electric Industrial Co., Ltd., Osaka, Japan

[21] Appl. No.: 974,425

[22] Filed: Nov. 12, 1992

[30] Foreign Application Priority Data

Nov. 14, 1991 [JP] Japan ..... 3-298761

[51] Int. Cl.[6] ..... F04C 29/02; B01D 45/08

[52] U.S. Cl. ..... 418/55.6; 418/88; 418/DIG. 1; 55/464

[58] Field of Search ..... 418/55.6, 88, 151, DIG. 1; 417/902, 366; 55/462, 464

[56] References Cited

U.S. PATENT DOCUMENTS

| | | | |
|---|---|---|---|
| 2,013,777 | 9/1935 | Dennedy | 418/DIG. 1 |
| 3,250,461 | 5/1966 | Parker | 417/902 |
| 5,087,170 | 2/1992 | Kousokabe et al. | 417/366 |

FOREIGN PATENT DOCUMENTS

| | | | |
|---|---|---|---|
| 58-170893 | 10/1983 | Japan | 418/DIG. 1 |
| 61-205392 | 9/1986 | Japan | 418/DIG. 1 |
| 61-212689 | 9/1986 | Japan . | |
| 63-150491 | 6/1988 | Japan | 418/55.6 |
| 63-208689 | 8/1988 | Japan | 418/151 |
| 1177484 | 7/1989 | Japan | 418/55.6 |
| 3179193 | 8/1991 | Japan | 418/DIG. 1 |
| 3206388 | 9/1991 | Japan | 418/88 |

*Primary Examiner*—John J. Vrablik

*Attorney, Agent, or Firm*—Stevens, Davis, Miller & Mosher

[57] ABSTRACT

The space in a closed container is divided into two parts by a partition wall member, gas jetting holes through which a high pressure gas released from a compression mechanism section is passed are formed in the partition wall member and a gas collision plate is disposed in opposed relation to the gas jetting holes, and therefore, there is provided a compressor of high achievement factor which is capable of preventing the discharge of oil from the compressor to a refrigerating cycle from being increased even if operated at high rotational frequency.

6 Claims, 4 Drawing Sheets

MOTOR COMPRESSOR WITH LUBRICANT SEPARATION

BACKGROUND OF THE INVENTION

1. Field of the Invention

The present invention relates to a motor compressor which is to be used in a cooling system of an air conditioner, refrigerator or the like.

2. Description of the Prior Art

Heretofore, motor compressors including a rotary compressor and a scroll compressor have been used in the cooling system of the air conditioner, refrigerator and the like.

This kind of compressor is shown in FIG. 1 of Japanese Patent Unexamined Publication No. 61-212689.

As shown in this drawing, within a closed container 101 are disposed a compression mechanism section 102 , a stator 104 and a rotor 105 which constitute a motor 103 , and a crankshaft 106 serving to transmit rotation of the motor 103 to the compression mechanism section 102 . Further, end plates of the closed container 101 are provided with a suction pipe 107 through which a low pressure refrigerant gas is to be sucked and a discharge pipe 108 through which a high pressure refrigerant gas is to be discharged.

With the above construction, as the rotor 105 constituting the motor 103 is rotated, rotation of this rotor 105 is transmitted through the crankshaft 106 to the compression mechanism section 102 . As the compression mechanism section 102 is rotated to perform the compressing function, a low pressure refrigerant gas sucked from the suction pipe 107 is compressed by the compression mechanism section 102 to become a high pressure refrigerant gas which is in turn released into the closed container 101 . Then, the high pressure refrigerant gas is passed through the space in the motor 103 and, after cooling the stator 104 and the rotor 105, discharged through the discharge pipe 108 to a refrigerating cycle (not shown).

However, in this kind of compressor, during an ordinary operation, in order to increase the compression efficiency by sealing the gap in the compression mechanism section 102 , oil is mixed in the refrigerant gas under compression. Further, within the closed container 101, lubricating oil is stirred by the rotor 105 of the motor so that a large number of drops of oil are scattered.

Therefore, since the high pressure refrigerant gas released from the compression mechanism section 102 into the closed container 101 is made to come into further contact with a large number of oil drops and catch the same here, a large quantity of oil is discharged through the discharge pipe 108 to the refrigerating cycle. Particularly, if the number of revolutions of the compressor is increased to increase the discharge of the refrigerant, the ratio of discharge of the oil (weight of oil to be discharged/weight of refrigerant to be discharged) is increased remarkably.

With the increase of the discharge of the oil from the compressor to the refrigerating cycle (as the ratio of discharge of the oil exceeds approx. 0.3%), not only is the pressure loss of the pipeline of the refrigerating cycle increased, but also the efficiency of heat exchange effected by the heat exchanger such as a condenser, an evaporator or the like is reduced, thereby giving rise to a problem that the refrigerating ability cannot be increased even if the number of revolutions of the compressor is increased or the factor of achievement of the refrigerating cycle is deteriorated.

SUMMARY OF THE INVENTION

Accordingly, an object of the present invention is to provide a compressor of high achievement factor which is capable of preventing the discharge of oil from the compressor to a refrigerating cycle from being increased even if the compressor is operated at high rotational frequency.

To solve the above problem that the discharge of oil from the compressor is increased, according to the present invention, the space in a closed container is divided into two parts by a partition wall member, gas jetting holes through which a high pressure gas released from a compression mechanism section is passed are formed in the partition wall member, and a gas collision plate is disposed in opposed relation to the gas jetting holes.

Refrigerant gas containing a large quantity of oil is jetted in a jet stream through the gas jetting holes formed in the partition wall member so that it collides against the gas collision plate at high speed and then spreads along the collision plate. In this case, since only the oil adheres to the collision plate, the oil is separated from the refrigerant gas, with the result that the amount of oil coming out of the compressor through the discharge pipe, that is, the discharge of oil is remarkably reduced.

Further, according to the present invention, a discharge pipe fixed to an end plate of the closed container is bent within the closed container so that the bent portion is surrounded by a box member which has the same function as the collision plate.

Since the discharge pipe fixed to the end plate of the closed container is bent within the closed container so that the bent portion is surrounded by the box member, the refrigerant gas has many chances of coming in contact with the box member as it makes many turns and twists within the closed container until it comes out through the discharge pipe. As a result, the oil contained in the refrigerant gas can be separated efficiently due to collision against the box member.

DETAILED DESCRIPTION OF THE PREFERRED EMBODIMENTS

Description will be given below of a preferred embodiment of the present invention with reference to the drawings.

Figure 1:
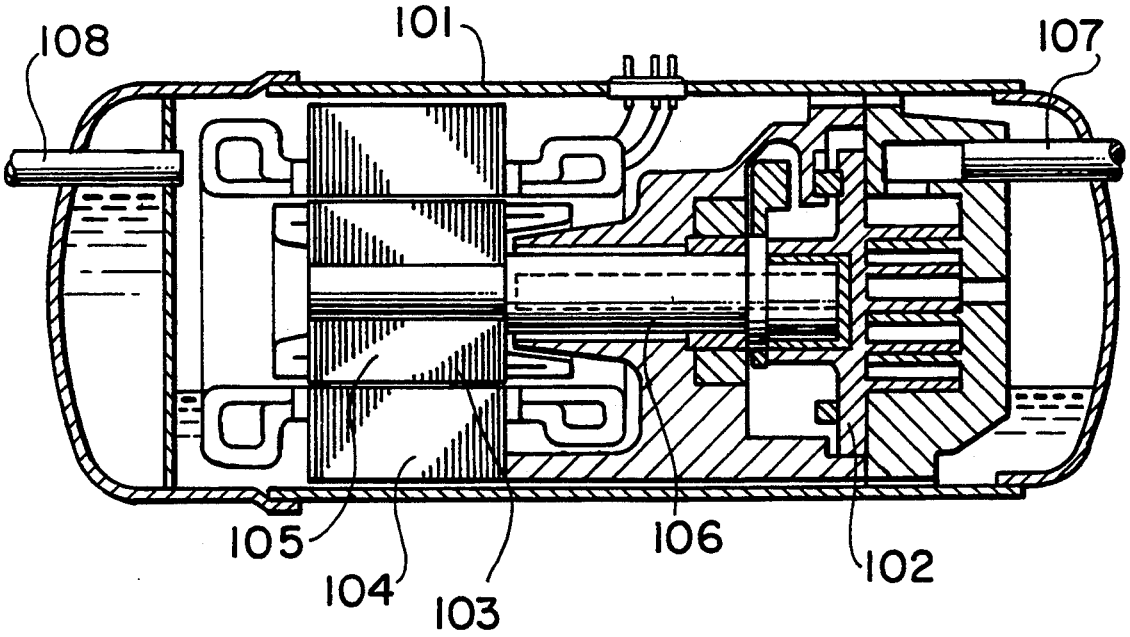
FIG. 1 PRIOR ART
FIG. 1 is a sectional view of a conventional scroll compressor.
Figure 2:
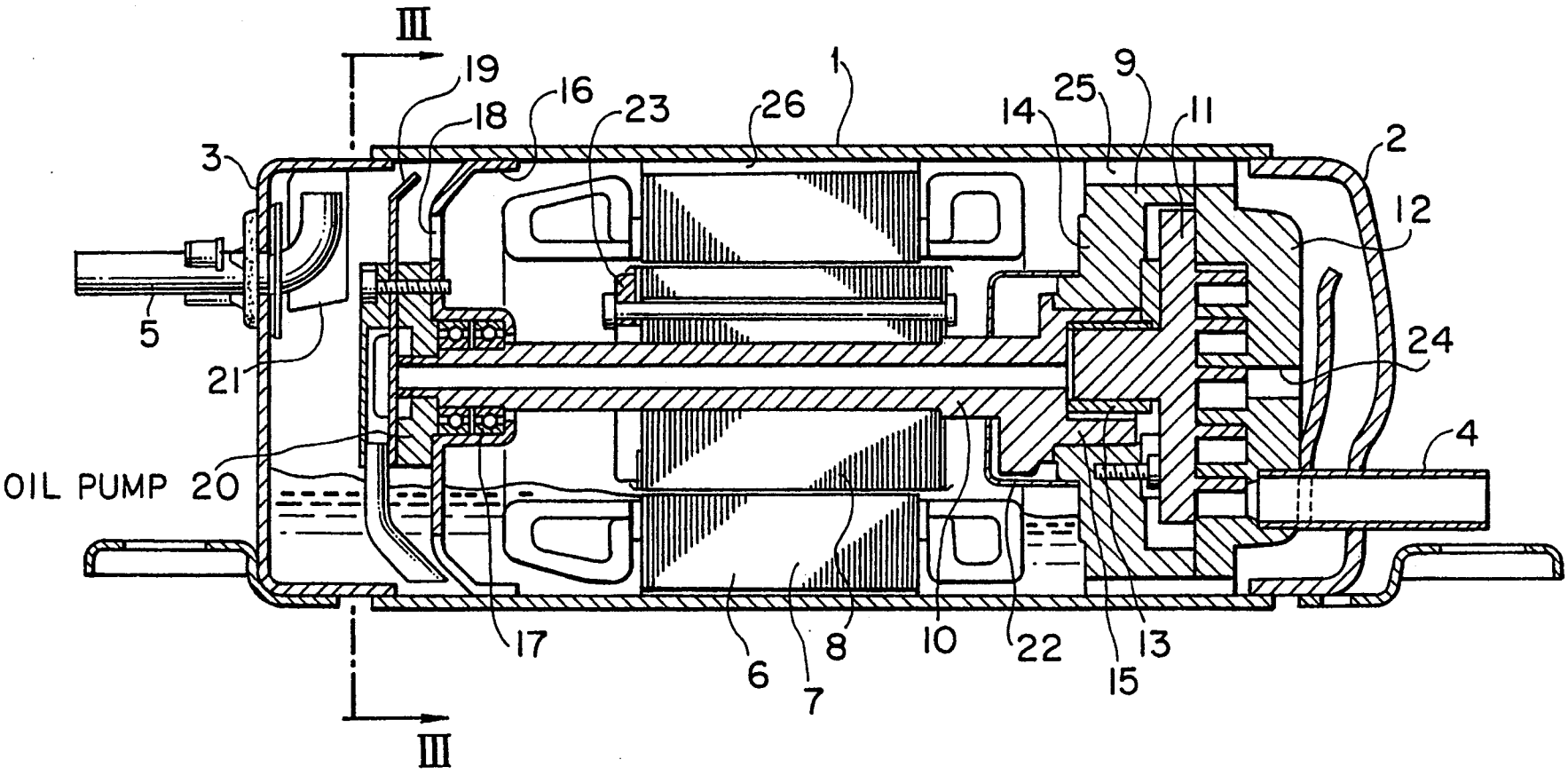
FIG. 2 is a sectional view of a scroll compressor according to a first embodiment of the present invention.

FIG. 2 shows an embodiment of the present invention.

In this drawing, reference numeral 1 denotes a closed container, numerals 2 and 3 denote end plates of the closed container, 4 denotes a suction pipe, and 5 denotes a discharge pipe. Reference numeral 6 denotes a motor, 7 denotes a stator of the motor, 8 denotes a rotor of the motor, and 9 denotes a compression mechanism section. Reference numeral 10 denotes a crankshaft which serves to transmit the turning force of the motor to the compression mechanism section 9. Since this embodiment is a scroll compressor, the compression mechanism section 9 comprises a swivel scroll 11, a fixed scroll 12, a swivel bearing 13 and a bearing member 14. The bearing member 14 supports a large shaft portion 15 of the crankshaft 10. Reference numeral 16 denotes a partition wall member which is fixed in the closed container 1 and serves to divide the closed container 1 into two parts including a space in which the compression mechanism section 9 exists and another space in which the discharge pipe 5 exists.

At the central portion of the partition wall member 16 is fixed a second bearing 17 which serves to support one end of the crankshaft 10. Further, the partition wall member 16 is formed therein with a plurality of gas jetting holes 18 through which a refrigerant gas is passed. And, a gas collision plate 19 is disposed in opposed relation to the gas jetting holes 18. Reference numeral 20 denotes an oil pump serving to supply lubricating oil to the sliding portions of the compression mechanism section 9. A suction plate having a suction port of the oil pump 20 is extended so as to form the gas collision plate 19. Reference numeral 21 denotes a box member which is so formed as to surround the discharge pipe 5, and the discharge pipe 5 is bent upwards within the box member 21.

Further, a first balance weight 22 is attached on the crankshaft 10 at a portion thereof adjacent to the large shaft portion 15, while a second balance weight 23 is attached on the motor rotor 8 at a portion thereof adjacent to the partition wall member 16.

Next, operation of the scroll compressor having such construction will be described.

With the rotation of the motor rotor 8, the crankshaft 10 and the swivel bearing 13 are rotated. As a result, the swivel scroll 11 is caused to move circularly around the fixed scroll 12 so that a compressing function takes place in a space defined between the swivel scroll 11 and the fixed scroll 12. Then, a low pressure refrigerant gas is sucked from the suction pipe 4, compressed in the space between the swivel scroll 11 and the fixed scroll 12, and released into the closed container 1 through an exhaust hole 24. Since oil is mixed in the refrigerant gas under compression in order to increase the compression efficiency by sealing the gap between the scrolls, the released high pressure refrigerant gas contains a fixed amount of oil. Thereafter, the high pressure refrigerant gas is passed through a gas passage 25 formed in the compression mechanism section 9 and another gas passage 26 formed in the stator 7 of the motor until it reaches a space enclosed by the stator 7 and the partition wall member 16. In this space, a large number of oil drops rolled up by the motor rotor 8 are scattered so that the refrigerant gas catches these oil drops so as to contain a large quantity of oil.

Subsequently, the refrigerant gas containing a large quantity of oil is jetted in a jet stream through the gas jetting holes 18 formed in the partition wall member 16 so that it collides against the gas collision plate 19 at great speed. After colliding against the gas collision plate 19 at great speed, the refrigerant gas is made to flow as it adheres to this plate, resulting in that the gas and the plate are kept in contact with each other for a long time. During this contact, the oil contained in the refrigerant gas sticks to the collision plate 19 successively. The oil sticking to the plate grows into larger oil drops on the gas collision plate 19 due to its surface tension until it flows downwards.

After colliding against the gas collision plate 19, the refrigerant gas makes a detour passing over the outer periphery of the gas collision plate 19 and coming round the box member 21, and finally comes out of the closed container 1 through the bent discharge pipe 5. When the refrigerant gas flows as it makes a detour about the box member 21, the refrigerant gas comes in contact with the box member 21 so that the remaining oil is further separated.

The oil contained in the refrigerant gas can be nearly wholly removed owing to collision separation and contact separation described above.

Figure 3:
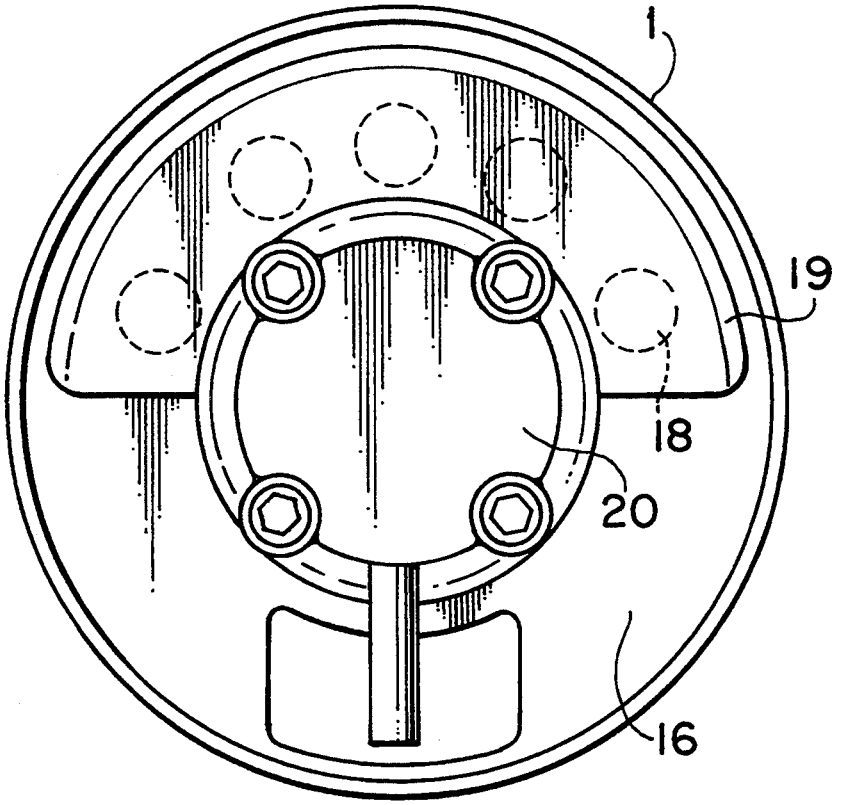
FIG. 3 is a sectional view of the scroll compressor shown in FIG. 2 as viewed from an arrow mark direction along III—III plane.

FIG. 3 is a sectional view taken along a line III—III in FIG. 2. The gas jetting holes 18 formed in the partition wall member 16 are arranged on a circle and the gas collision plate 19 is formed in the shape of a fan. In consequence, not only can the gas jetting holes 18 can be arranged effectively, but also the whole area of the gas collision plate 19 can be used for the oil separation effectively, and therefore, the efficiency of separating the oil within the closed container 1 can be enhanced.

Further, the outer peripheral portion of the fan-shaped gas collision plate 19 is inclined toward the partition wall member 16. Therefore, the time during which the refrigerant gas is kept in contact with the gas collision plate 19 is prolonged, thereby improving the oil separating efficiency by an amount corresponding to that prolonged time.

In addition, a lower wall surface of the box member 21 surrounding the discharge pipe 5 is inclined downwards. This allows the oil separated by the box member to easily come down. In consequence, the separated oil is hardly caught again by the refrigerant, thereby promoting the oil separating effect of the box member 21.

Figure 4:
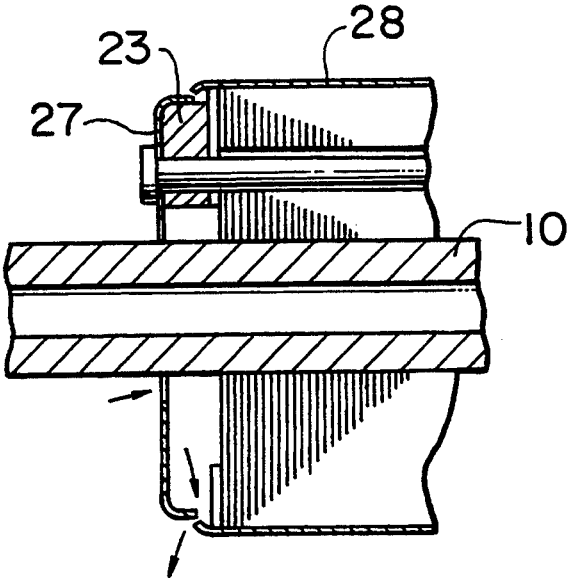
FIG. 4 is a sectional detail view of the motor rotor section for explanation of the present invention.

However, as shown in FIG. 4, if there is a gap at the joint between an outer cylinder 28 of the rotor 8 and a cover 27, there is caused a circulation of the refrigerant gas as indicated by arrow marks with the rotation of the rotor 8. The circulation causes the amount of scattered oil to be increased, with the result that the discharge of oil from the compressor is increased.

Figure 5:
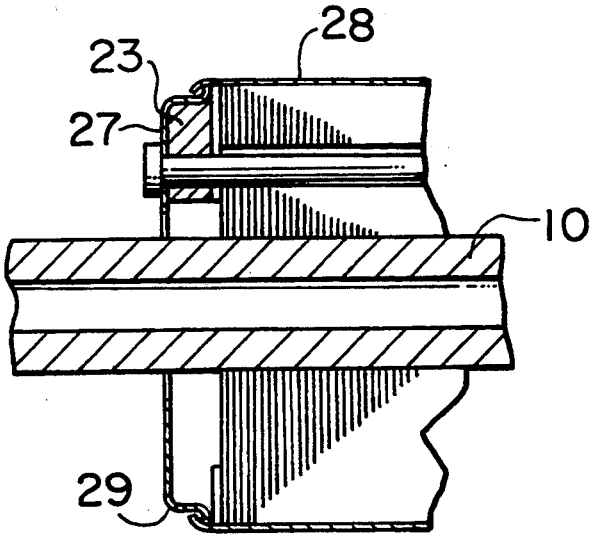
FIG. 5 is a sectional detail view of the motor rotor section of the scroll compressor according to the present invention.

Accordingly, in the present invention, the second balance weight 23 is covered with the cover 27 so as to make even or obviate stepped portions in the circumferential direction, and the outer cylinder 28 of the rotor 8 and the cover 27 are overlapped each other at the joint therebetween so as to prevent any gap from being left at this joint as shown in FIG. 5.

Further, the cover 27 is formed therein with a small hole 29 at a position remote from or opposite to the balance weight and located in the outer most peripheral portion. Therefore, even if the oil has gathered in the space in the cover 27 while the operation is suspended, the oil can be made to come out of the closed container through this small hole due to centrifugal force resulting from the rotation of the rotor 8. As a result, the gathered oil has no effect on the balance, resulting in the silent operation.

The space in the closed container is divided into two parts by the partition wall member, the gas jetting holes through which the high pressure gas released from the compression mechanism section is passed are formed in the partition wall member, and the gas collision plate is disposed in opposed relation to the gas jetting holes, and therefore, a large quantity of oil is separated from the refrigerant gas due to collision separation. As a result, it is possible to remarkably reduce the amount of oil coming out of the compressor through the discharge pipe, that is, the discharge of oil.

Further, in the compressor which is installed substantially horizontally as a whole, the bearing serving to support one end of the crankshaft and the oil pump are fixed to the partition wall member and the gas collision plate is fixed to the oil pump, and therefore, parts for supporting the bearing, oil pump and gas collision plate are dispensed with, thereby simplifying the construction.

In addition, since the gas collision plate is formed by extending the suction plate or the discharge plate constituting the oil pump, the number of parts is decreased to thereby reduce the cost of the compressor.

Moreover, the gas jetting holes are formed in the partition wall member so as to be arranged on a circle and the gas collision plate is formed in the shape of a fan, and therefore, the gas jetting holes can be arranged effectively and the whole area of the collision plate can be used for the oil separation effectively, thereby enhancing the efficiency of separating the oil within the closed container.

Further, the outer peripheral portion of the fan-shaped gas collision plate is inclined toward the partition wall member so that the time during which the refrigerant gas is kept in contact with the collision plate is prolonged, thereby improving the oil separating efficiency by an amount corresponding to that prolonged time.

Besides, since the discharge pipe fixed to the end plate of the closed container is bent within the closed container so that the bent portion is surrounded by the box member, the refrigerant gas has many chances of coming in contact with the box member as it makes many turns and twists within the closed container until it comes out through the discharge pipe, with the result that the oil contained in the refrigerant gas can be separated efficiently due to contact with the box member.

Moreover, since the lower wall surface of the box member surrounding the discharge pipe is inclined downwards, the oil separated by the box member is allowed to easily come down. As a result, the separated oil is hardly caught again by the refrigerant, thereby promoting the oil separating effect performed by the box member.

In addition, the balance weight disposed at the end of the rotor of the motor is covered with the cover so as to make even in the circumferential direction, and the outer cylinder of the rotor and the cover are overlapped each other at the joint there between so as to prevent any gap from being left at the joint, and therefore, the oil drops to be scattered within the closed container are reduced, with the result that the discharge of oil is decreased.

Furthermore, the cover is formed therein with the small hole at a position remote from or opposite to the balance weight and located in the outermost peripheral portion, and therefore, the oil is prevented from gathering in the space in the cover so that the high speed operation can be performed without exerting any influence on the balance, thereby making it possible to obtain the silent operation.

What is claimed is:

1. A motor compressor comprising, within a closed container thereof:

a compression mechanism section;

a motor serving to drive said compression mechanism section;

a crankshaft serving to transmit a turning force of said motor to said compression mechanism section;

a partition wall member serving to divide a space in said closed container into two parts including a first space in which said compression mechanism section exists and a second space, said partition wall member being formed therein with gas jetting holes through which a high pressure gas released from said compression mechanism section is passed;

a discharge pipe extending into said second space, a gas collision plate disposed between said partition wall member and an inner surface of said closed container in opposed relation to said gas jetting holes;

a bearing serving to support one end of the crankshaft; and an oil pump serving to supply lubricating oil to sliding portions of the compression mechanism section, said bearing and oil pump being fixed to the partition wall member, and wherein the gas collision plate is attached to said oil pump, and the compression mechanism section is installed substantially horizontally as a whole.

2. A motor compressor according to claim 1, wherein said gas jetting holes are formed in the partition wall member so as to be arranged on a circle, and said gas collision is formed in the shape of a fan.

3. A motor compressor according to claim 2, further comprising a suction plate which comprises the oil pump and which is extended so as to form the gas collision plate.

4. A motor compressor according to claim 3, wherein said gas jetting holes are formed in the partition wall member so as to be arranged on a circle, and said gas collision is formed in the shape of a fan.

5. A motor compressor comprising, within a closed container thereof:

a compression mechanism section;

a motor serving to drive said compression mechanism section;

a crankshaft serving to transmit a turning force of said motor to said compression mechanism section;

a partition wall member serving to divide a space in said closed container into two parts including a first space in which said compression mechanism section exists and a second space, said partition wall member being formed therein with gas jetting holes through which a high pressure gas released from said compression mechanism section is passed;

a discharge pipe extending into said second space; and a gas collision plate disposed between said partition wall member and an inner surface of said closed container in opposed relation to said gas jetting holes;

wherein said gas jetting holes are formed in the partition wall member so as to be arranged on a circle, and said gas collision plate is formed in the shape of a fan.

6. A motor compressor according to claim 5, wherein the outer peripheral portion of the fan-shaped gas collision plate is inclined toward the partition wall member.

* * * * *